US007298074B2

(12) United States Patent
Yamazaki

(10) Patent No.: US 7,298,074 B2
(45) Date of Patent: Nov. 20, 2007

(54) IMAGE DISPLAY DEVICE HAVING A SPACER STRUCTURE FOR REDUCING CURRENT CROWDING

(75) Inventor: Koji Yamazaki, Ebina (JP)

(73) Assignee: Canon Kabushiki Kaisha, Tokyo (JP)

( * ) Notice: Subject to any disclaimer, the term of this patent is extended or adjusted under 35 U.S.C. 154(b) by 497 days.

(21) Appl. No.: 11/025,988

(22) Filed: Jan. 3, 2005

(65) Prior Publication Data

US 2005/0146260 A1 Jul. 7, 2005

(30) Foreign Application Priority Data

Jan. 5, 2004 (JP) ..... 2004-000161

(51) Int. Cl.
*H01J 1/88* (2006.01)

(52) U.S. Cl. ..... 313/292; 313/495; 313/288; 313/238; 315/169.1

(58) Field of Classification Search ..... None
See application file for complete search history.

(56) References Cited

U.S. PATENT DOCUMENTS

| | | | | |
|---|---|---|---|---|
| 5,614,781 | A | 3/1997 | Spindt et al. | 313/422 |
| 5,742,117 | A | 4/1998 | Spindt et al. | 313/422 |
| 6,144,154 | A | 11/2000 | Yamazaki et al. | 313/395 |
| 6,184,619 | B1 | 2/2001 | Yamazaki et al. | 313/495 |
| 6,246,168 | B1 * | 6/2001 | Kishi et al. | 313/495 |
| 6,351,065 | B2 | 2/2002 | Yamazaki et al. | 313/497 |
| 6,511,155 | B1 | 1/2003 | Fassler et al. | 347/35 |
| 6,884,138 | B1 * | 4/2005 | Ando et al. | 445/24 |
| 7,053,537 | B2 * | 5/2006 | Hiroike et al. | 313/292 |
| 7,145,288 | B2 * | 12/2006 | Shimizu | 313/495 |

FOREIGN PATENT DOCUMENTS

| | | |
|---|---|---|
| EP | 0 690 472 | 1/1995 |
| EP | 1 478 006 | 11/2004 |
| JP | 8-180821 | 7/1996 |
| JP | 2003-136741 | 5/2003 |

* cited by examiner

*Primary Examiner*—Sikha Roy
(74) *Attorney, Agent, or Firm*—Fitzpatrick, Cella, Harper & Scinto

(57) ABSTRACT

An image forming device includes a rear plate having a conductor set to a low voltage, an electron emitter disposed on the rear plate, the electron emitter including the conductor, and a face plate having an electrode set to a high voltage and facing the rear plate. An image forming source is provided on the face plate and includes the electrode. A spacer is electrically connected to the conductor and the electrode and includes an insulating substrate having a first end surface facing the rear plate, a second end surface facing the electrode, and side surfaces connecting the first end surface and the second end surface. A first high-resistance film covers the side surfaces of the insulating substrate, and a second high-resistance film covers at least one of the first end surface and the second end surface of the insulating substrate and has a sheet resistance greater than or equal to a sheet resistance of the first high-resistance film. In addition, the spacer, the conductor and the electrode are electrically connected via a third high-resistance film interposed between the conductor or the electrode and the second high-resistance film.

7 Claims, 9 Drawing Sheets

R: RED PHOSPHOR
G: GREEN PHOSPHOR
B: BLUE PHOSPHOR

IMAGE DISPLAY DEVICE HAVING A SPACER STRUCTURE FOR REDUCING CURRENT CROWDING

BACKGROUND OF THE INVENTION

1. Field of the Invention

The present invention relates to an image forming device, such as a display using an electron beam and, more specifically, to an image forming device including spacers.

2. Description of the Related Art

A known image forming device using an electron emitter is a flat display panel. The known flat display panel comprises an electron source substrate including a plurality of cold cathode electron emitters and an anode substrate including an anode electrode and phosphors. The electron source substrate and anode substrate are disposed parallel to each other. A vacuum is generated between the electron source substrate and the anode substrate. Generally known cold cathode electron emitters are surface-conduction type emitters, field electron emission (FE) type emitters, and metal-insulator-metal (MIM) type emitters. The flat display panel including known cold cathode electron emitters is light-weight and has a large display area compared to other widely used CRTs. Moreover, the flat display panel is brighter and is capable of displaying higher quality images compared to other flat display panels using liquid crystal and flat display panels such as plasma displays and electroluminescent displays.

In general, the above-described image forming device comprises a face plate and a rear plate facing each other. The face plate is the display surface for displaying an image. The face plate includes a metal back, which receives an acceleration voltage $V_a$, and a fluorescent film. The rear plate is the electron source for generating light from the phosphors. The rear plate includes cold cathode electron emitters and wires, wherein the wires electrically connect the electron emitters and run in the longitudinal and horizontal directions. Sidewalls seal the circumference of the face plate and the rear plate, forming a vacuum vessel. Spacers are interposed between the face plate and the rear plate to maintain the plates apart from each other at a predetermined distance and to support the plates against atmospheric pressure. The spacers are usually interposed between and are in contact with the conductor of the rear plate (e.g., the wires in the horizontal direction) and the electrode on the face plate (e.g., the metal back) (for example, refer to U.S. Pat. Nos. 5,614,781 and 5,742,117 and Japanese Patent Laid-Open No. 08-180821).

In such an image forming device, sometimes the spacers emit a secondary electron when a part of an electron beam or a reflected electron strikes the surface. This secondary electron generates an electric potential in the area where the secondary electron was emitted from. Accordingly, the electric potential distribution at the spacer and the vicinity is distorted. As a result, not only the trajectory of the electron beam becomes unstable but also an electric discharge will occur inside the image forming device.

To prevent electrical charging of the spacers, the spacers may be formed of an insulating substrate covered with a high-resistance film, which is capable of preventing electrical charging. This method of preventing electrical charging is disclosed in, for example, U.S. Pat. Nos. 5,614,781 and 5,742,117 and Japanese Patent Laid-Open No. 08-180821.

The inventors propose a more preferable method for preventing electrical charging of spacers in which spacers formed of an insulating substrate covered with a high-resistance film are disposed intermittently in contact with the conductors on the rear plate (refer to Japanese Patent Application No. 2003-136741).

However, when the contact area of the spacer actually in contact with the conductor is small in comparison with the surface area (including the contact area) that faces the conductor, electrical currents are converged (or, in other words, current crowding occurs) at the edge of the contact area. This current crowding occurs, for example, when the spaces contact the conductors intermittently, as described above, or when the thickness (width) of the planer spacers is greater than the width of the conductors in contact.

FIG. 11 illustrates the latter case in which the contact area of a spacer 1020 contacting a conductor (horizontal wire 1013) on a rear plate 1015 or an electrode (metal back 1019) on a face plate 1017 is smaller than the area of the surface including the contact area. In such a case, current crowding occurs at the edges of the contact area (points b in the drawing). Due to current crowding, heat is generated locally at the points b and the vicinity. Therefore, depending on the type of material used for a high-resistance film 1001, the property of the film (such as resistance) may change when the high-resistance film 1001 is used for a long period of time (i.e., when $V_a$ is applied for a long period of time). As a result, the electric field in the vicinity of the spacer 1020 is distorted, causing the formed images to be distorted. FIG. 11 also illustrates an insulating substrate 1000, a fluorescent film 1018, a longitudinal wire 1014, and an insulating layer 1021.

Current crowding that occurs at some of the edges of the high-resistance film even when the high-resistance film is disposed on the edge of the spacer, as illustrated in FIG. 11, is known to be caused by the relationship of electric properties between the high-resistance film on the side of the spacer, the film on the edge of the spacer, and the conductor in contact with the spacer in addition to the above-described case in which the contact area of the spacer is only partially in contact with the rear plate or the face plate contact. When the entire end surface of the spacer is a contact area, it is desired to effectively use the entire high-resistance film on the end surface as a current path.

SUMMARY OF THE INVENTION

The present invention has taken into consideration the above mentioned problems, and its main object is to provide a panel for an image forming device, such as a planer display panel including cold cathode electron emitters, in which images are not distorted even when the panel is used for a long period of time.

According to the present invention, a spacer has a first high-resistance film on an exposed surface and a second high-resistance film on a surface contacting a rear plate or a face plate. When this spacer contacts the rear plate or the face plate through a third high-resistance film, local current crowding is prevented from occurring at the contact area and the vicinity of the high-resistance films. As a result, a local change in resistance at the contact area of the high-resistance film can be prevented. Accordingly, an image forming device capable of stably maintaining an excellent image having high brightness for a long period of time is provided.

An image forming device comprises a rear plate having a conductor set to a low voltage, a face plate having an electrode set to a high voltage, the face plate facing the rear plate, and a spacer electrically connected to the conductor and the electrode. The spacer comprises an insulating substrate having a first end surface facing the rear plate, a second end surface facing the electrode, and side surfaces connecting the first end surface and the second end surface, a first high-resistance film covering the side surfaces of the insulating substrate, and a second high-resistance film covering at least one of the first end surface and the second end surface of the insulating substrate and having a sheet resistance greater than or equal to a sheet resistance of the first high-resistance film. In the image forming device, the spacer and the conductor and the electrode are electrically connected via a third high-resistance film interposed between the conductor or the electrode and the second high-resistance film. Moreover, the resistivity $\rho_2$ and the film thickness $t_2$ of the second high-resistance film and the resistivity $\rho_3$ and the film thickness $t_3$ of the third high-resistance film satisfy the formulae below:

[Formulae 1]

$$\frac{\rho_3}{\rho_2} \geq 0.06 \times \left(\frac{t_3}{t_2}\right)^{-0.6} \text{ and } \frac{\rho_3}{\rho_2} \geq 0.05 \quad (1)$$

The second high-resistance film and the third high-resistance film of a preferable first embodiment of the image forming device according to the present invention satisfies the following Formulae 2.

[Formulae 2]

$$\frac{\rho_3}{\rho_2} \geq 3.6 \times \left(\frac{t_3}{t_2}\right)^{-1.2} \text{ and } \frac{\rho_3}{\rho_2} \geq 20 \quad (2)$$

The second high-resistance film and the third high-resistance film of a preferable second embodiment of the image forming device according to the present invention satisfies the following Formula 3.

[Formula 3]

$$0.001 \leq \frac{t_3}{t_2} \leq 1000 \quad (3)$$

The film thickness $t_2$ of the second high-resistance film and the film thickness $t_3$ of the third high-resistance film are both between $10^{-8}$ m and $10^{-5}$ m for a preferable third embodiment of the image forming device according to the present invention.

The resistivity $\rho_2$ of the second high-resistance film and the resistivity $\rho_3$ of the third high-resistance film are both between 0.1 Ωm and $10^8$ Ωm for a preferable fourth embodiment of the image forming device according to the present invention.

The sheet resistance of the second high-resistance film and the third high-resistance film are substantially the same for a preferable fifth embodiment of the image forming device according to the present invention.

The sheet resistance of the first high-resistance film is between $10^7$ Ω/sq and $10^{14}$ Ω/sq, and the sheet resistance of the second high-resistance film is between $10^8$ Ω/sq and $10^{15}$ Ω/sq for a preferable sixth embodiment of the image forming device according to the present invention.

Another embodiment of the present invention is a television apparatus including one of the above-mentioned image forming devices, a television signal receiving circuit, and an interface unit for connecting the image forming devices and the television signal receiving circuit.

Further objects, features and advantages of the present invention will become apparent from the following description of the preferred embodiments (with reference to the attached drawings).

DESCRIPTION OF THE PREFERRED EMBODIMENTS

A planer display panel according to embodiments of the image forming device of the present invention will be described in detail below.

Figure 1:
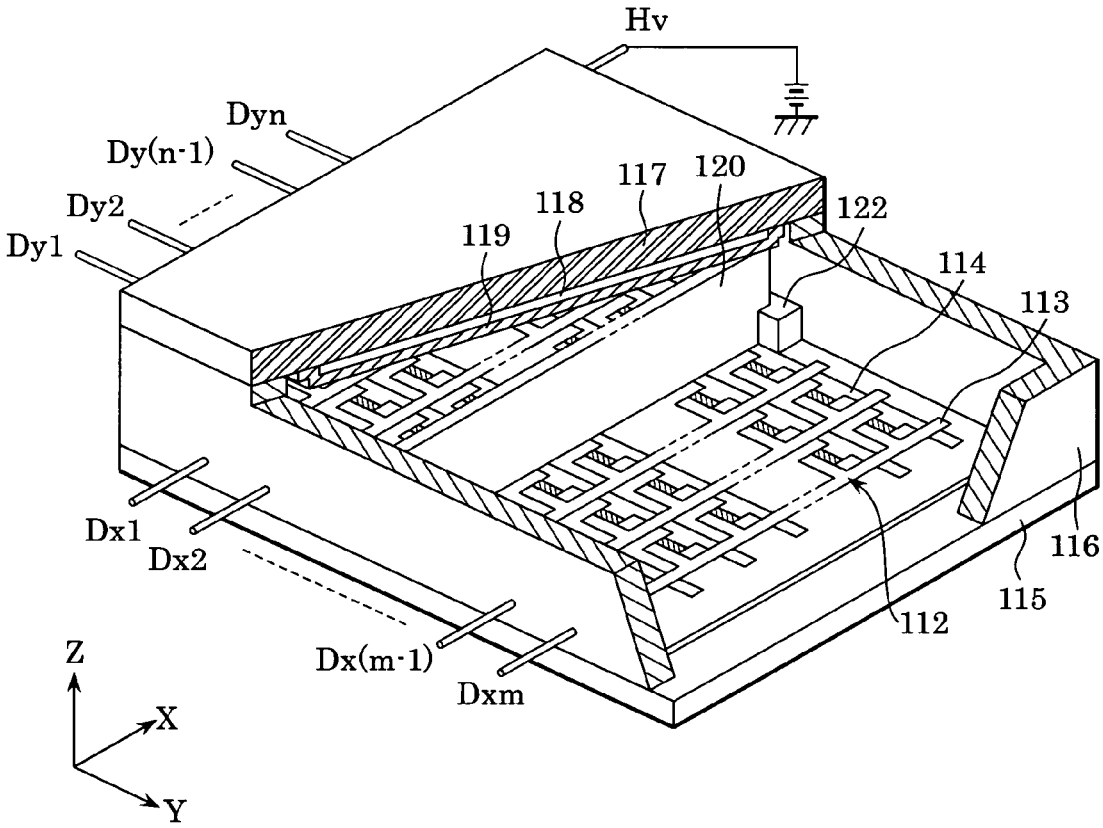
FIG. 1 is a perspective view partially illustrating the inner structure of a display panel according to the present invention.

FIG. 1 is a perspective view of an embodiment of a planer display panel. FIG. 1 also partially illustrates the inner structure of the planer display panel.

As illustrated in FIG. 1, a rear plate 115, a sidewall 116, and a face plate 117 form an airtight container that maintains a vacuum inside the display panel. The inside of the airtight container is a vacuum of about $10^{-4}$ Pa. To prevent the airtight container from being damaged by atmospheric pressure or unexpected shock, a spacer 120 is provided as part of an atmospheric pressure-resistant structure. The spacer 120 is fixed in an area outside the image display area by a spacer support member 122.

On the rear plate 115, a N×M number of cold cathode electron emitters 112 is provided (here, N and M represent a positive integer greater or equal to 2, and the number of cold cathode electron emitters 112 is determined in accordance with the required number of display pixels). The N×M cold cathode electron emitters 112 are arranged in a simple matrix with M horizontal wires 113 and N longitudinal wires 114. The intersections of the horizontal wires 113 and the longitudinal wires 114 are insulated by insulating layers 121 (refer to FIG. 2).

In this embodiment, the cold cathode electron emitters 112 are surface-conduction electron emitters arranged in a simple matrix. The present invention, however, is not limited to this, and other electron emitters such as field emission (FE) or metal-insulator-metal (MIM) electron emitters may also be used. Furthermore, the arrangement is not limited to a simple matrix.

Figure 3:
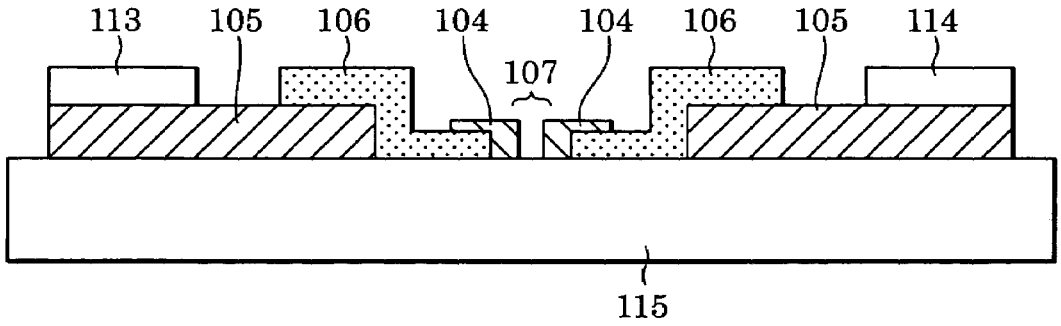
FIG. 3 is a schematic cross-sectional view of a cold cathode electron emitter used for the display panel according to the present invention.

FIG. 3 is a cross-sectional schematic view of one of the cold cathode electron emitters 112 according to this embodiment. FIG. 3 illustrates the rear plate 115, one of the horizontal wires 113, one of the longitudinal wires 114, element electrodes 105, conductive thin films 106, an electron emitting portion 107, and a carbon film 104. The electron emitting portion 107 is prepared by electric forming and electric activation. The carbon films 104 are deposited on the conductive thin films 106 in the vicinity of the electron emitting portion 107.

Figure 4:
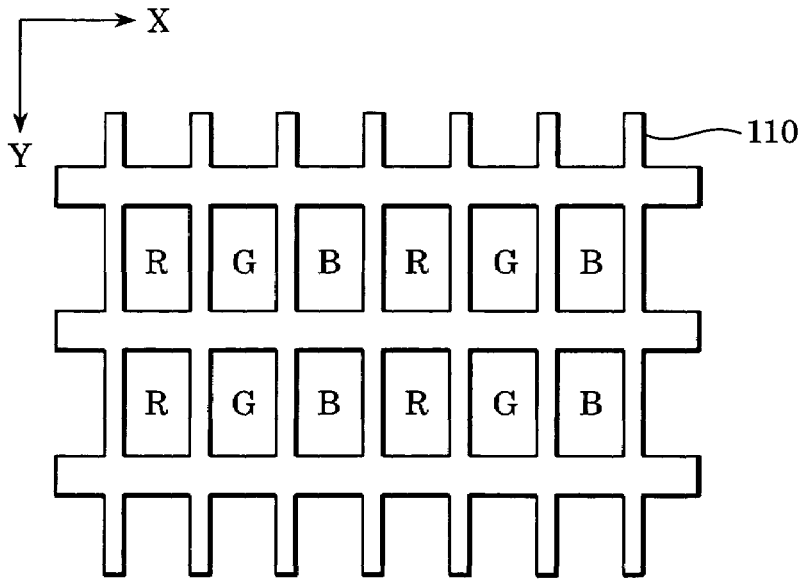
FIG. 4 is a plan view illustrating the alignment of phosphors used for a face plate of the display panel according to the present invention.

As illustrated in FIG. 1, a fluorescent film 118 is provided on the face plate 117. The display panel according to this embodiment is a color display. Thus, the fluorescent film 118 includes phosphors of the three primary colors used for a CRT, i.e., red, green, and blue. For example, the different-colored phosphors are arranged in stripes as illustrated in FIG. 4. Black conductors 110 are interposed between the stripes of the phosphors. The arrangement of the phosphors of the three different colors is not limited to the stripe pattern illustrated in FIG. 4. Instead, the phosphors may have a delta arrangement or any other arrangement that is in accordance with the arrangement of the cold cathode electron emitters 112.

To prepare a monochrome display panel, the fluorescent film 118 is composed of phosphors of a single color. In such a case, the black conductors 110 are not necessarily required.

A known metal back 119 used for a CRT is attached to the side of the fluorescent film 118 opposite from the face plate 117. The metal back 119 functions as an anode electrode for applying an electron beam acceleration voltage $V_a$.

Figure 2:
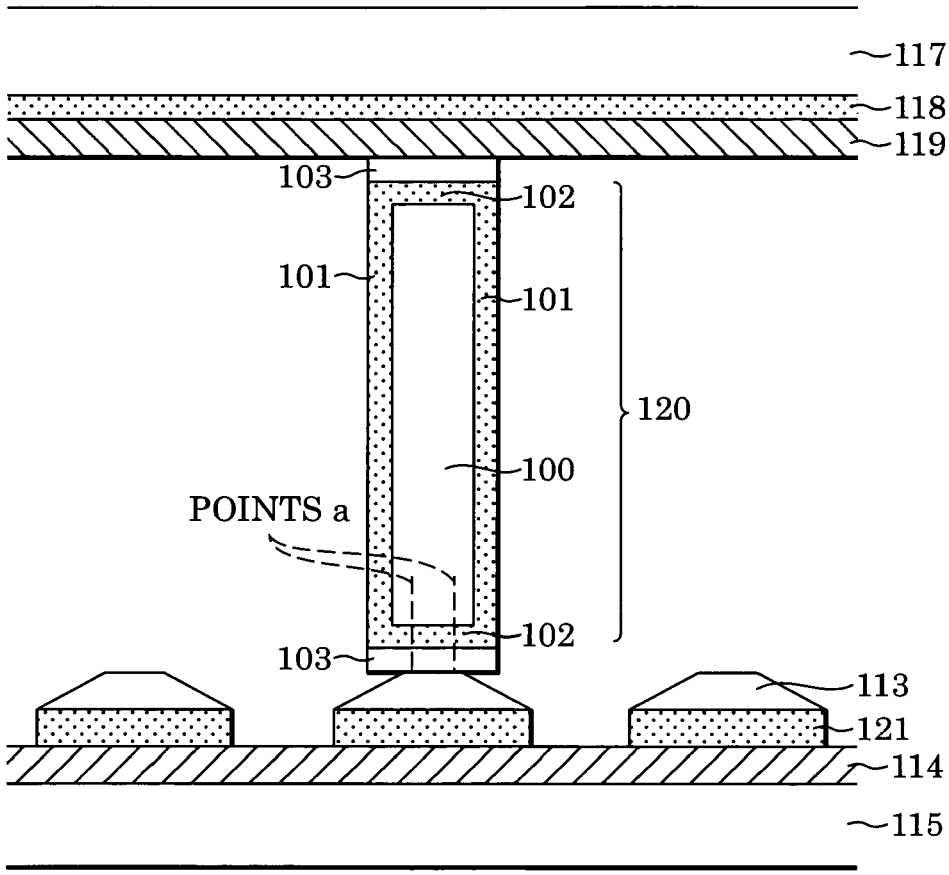
FIG. 2 is a cross-sectional view of a spacer and the vicinity in the display panel illustrated in FIG. 1.

FIG. 2 is a cross-sectional schematic view of the spacer 120, illustrated in FIG. 1, and its vicinity. The components that are the same as those in FIGS. 1 and 2 are indicated by the same reference numerals.

The spacer 120 is prepared by depositing a first high-resistance film 101 and a second high-resistance film 102 on the surface of a insulating substrate 100. The first and second high-resistance films 101 and 102 prevent electrical charging. The number of spacers included in a display panel and their intervals, which are determined by the number of spacers required for resisting the atmospheric pressure, are disposed in the display panel.

The first high-resistance film 101 is a film covering the sides of the insulating substrate 100. The first high-resistance film 101 has a resistivity of $\rho_1$ and a film thickness of $t_1$. The second high-resistance film 102 is a film covering the first or second end surfaces of the spacer 120. The second high-resistance film 102 has a resistivity of $\rho_2$ and a film thickness of $t_2$. The insulating substrate 100 of the spacer 120 may be quartz glass, glass with a decreased amount of impurities such as sodium, soda lime glass, or ceramics material such as alumina. The material used for the insulating substrate 100 preferably should have a coefficient of thermal expansion similar to that of the materials used to form the airtight container.

The first high-resistance film 101 and the second high-resistance film 102 may be made of different materials and/or may have different thicknesses or, instead, may be made of substantially the same material having substantially the same thickness. In the latter case, $\rho_1$ substantially equals $\rho_2$ and $t_1$ substantially equals $t_2$.

The spacer 120 is electrically connected to the fluorescent film 118 and the metal back 119 on the inside of the face plate 117 and to the horizontal wires 113, the longitudinal wires 114, and the insulating layer 121 on the inside of the rear plate 115 via a third high-resistance film 103 deposited on the second high-resistance film 102. The third high-resistance film 103 has a resistivity of $\rho_3$ and a film thickness of $t_3$. In this embodiment, the spacer 120 is a thin plate and is disposed parallel the horizontal wires 113 and electrically connected to the horizontal wires 113.

The second high-resistance film 102 and the third high-resistance film 103 having the structures described above should preferably satisfy the condition represented by Formulae 4 (which is the same formula as Formulae 1 mentioned above) below:

[Formulae 4]

$$\frac{\rho_3}{\rho_2} \geq 0.06 \times \left(\frac{t_3}{t_2}\right)^{-0.6} \text{ and } \frac{\rho_3}{\rho_2} \geq 0.05 \quad (1)$$

Figure 11:
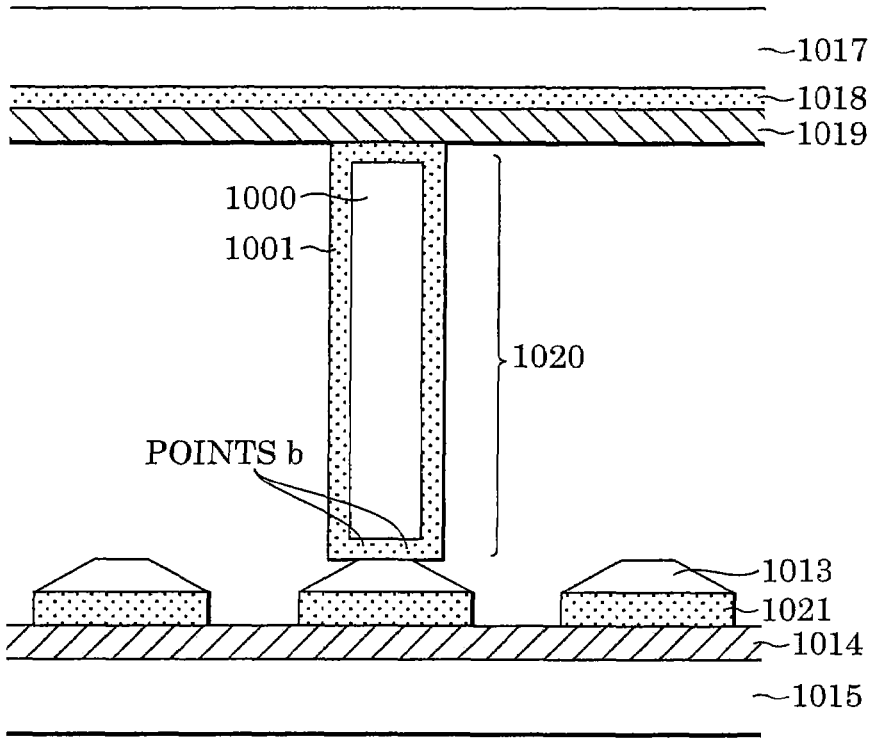
FIG. 11 (PRIOR ART)
FIG. 11 is a schematic view illustrating a problem to be solved by the present invention.

Formulae 4 indicate that current crowding is prevented more effectively when the second high-resistance film 102 of the spacer 120 contacts the rear plate 115 or the face plate 117 via the third high-resistance film 103 (refer to FIG. 2) compared to when the second high-resistance film 102 of the spacer 120 directly contacts the rear plate 115 or the face plate 117 without the third high-resistance film 103 (refer to FIG. 11). In other words, local current crowding on the second high-resistance film 102 can be alleviated when Formulae 4 are satisfied. In this way, quality (resistance) of the second high-resistance film 102 can be prevented from being altered locally due to a long-term application of a voltage. Furthermore, image distortion caused by the change in film quality at the spacer 120 and its vicinity can be prevented. Prevention of local current crowding according to the present invention will now be described below.

The current flow in the display panel having a structure according to the present invention and the current flow in a structure not according to the present invention are described below.

Figure 12:
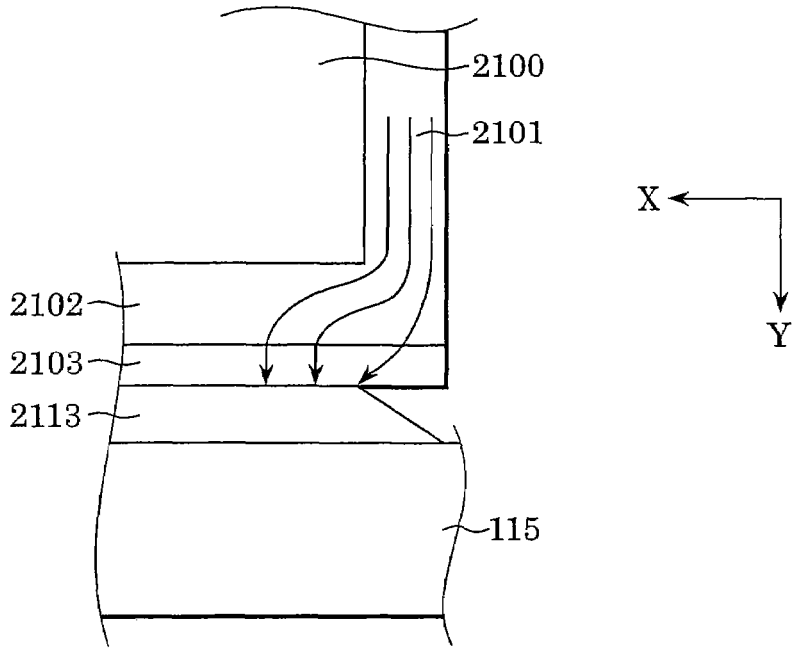
FIG. 12 is a schematic view illustrating the flow of electric currents in the lower portion of the spacer of the display panel according to the present invention.
Figure 13:
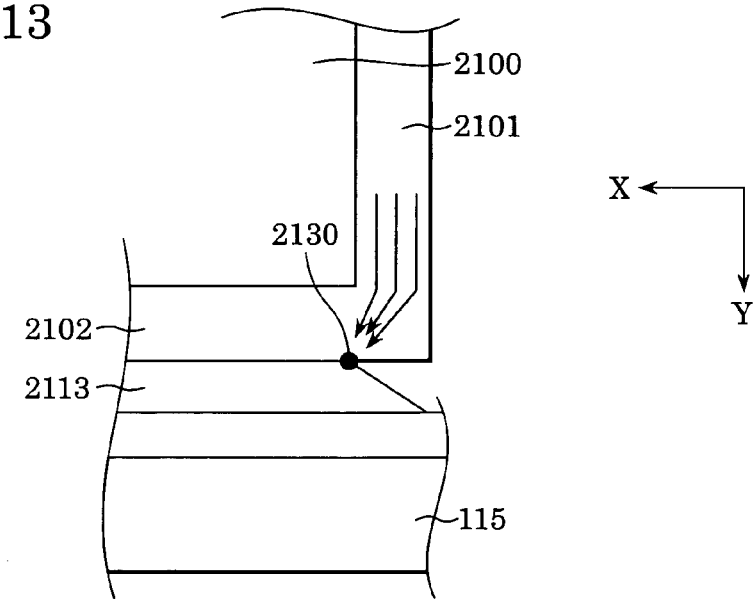
FIG. 13 is a schematic view illustrating the flow of electric currents in the lower portion of a spacer of a display panel of a comparative example.
Figure 14:
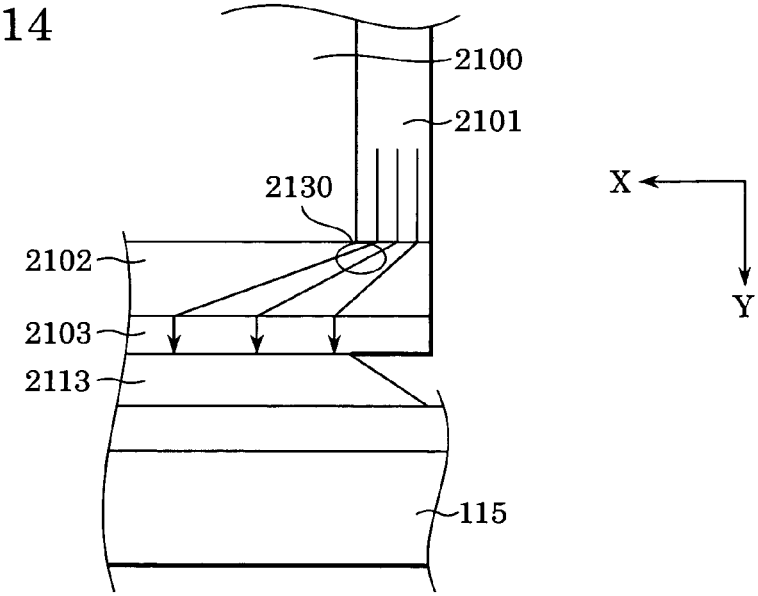
FIG. 14 is a schematic view illustrating the flow of electric currents in the lower portion of a spacer of a display panel of another comparative example.

FIG. 12 is schematic view of the current flow at the edge of the spacer in the display panel according to the present invention. In comparison with FIG. 12, FIG. 13 is a schematic view of the current flow at the edge of a spacer in a display panel not having a third high-resistance film 103. In comparison with FIG. 12, FIG. 14 is a schematic view of the current flow at the edge of the spacer in the display panel wherein the sheet resistance of the second high-resistance film is smaller than the sheet resistance of the first high-resistance film. The same components illustrated in FIGS. 12 to 14 are represented by the same reference numerals. FIGS. 12 to 14 include a spacer substrate (insulating substrate) 2100, a first high-resistance film 2101, a second high-resistance film 2102, a third high-resistance film 2103, a wiring electrode 2113, and a current crowding region 2130. The arrows in the drawings represent the flow of electricity. In the case illustrated in FIG. 13, the current flowing through the first high-resistance film 2101 at the edge of the spacer 2100 flows toward the wiring electrode 2113 via a pathway in the second high-resistance film 2102 having the smallest resistance because the sheet resistance of the second high-resistance film 2102 is greater than or equal to the first high-resistance film 2101. As a result, the current flows through a pathway having the shortest distance to the wiring electrode, as illustrated in the schematic view of FIG. 13. Consequently, this current flow generates a current crowding region 2130. In the case illustrated in FIG. 14, the current flowing through the first high-resistance film 2101 disperses in the second high-resistance film 2102 at the edge of the spacer 2100 because the sheet resistance of the second high-resistance film 2102 is smaller than the sheet resistance of the first high-resistance film 2101. More specifically, since the difference in sheet resistance causes the voltage drop in the second high-resistance film 2102 to be smaller than the voltage drop in the first high-resistance film 2101, the second high-resistance film 2102 appears to function as an electrode and, thus, the electric current disperses in the second high-resistance film 2102. Consequently, as illustrated in the schematic view of FIG. 14, the electric current disperses uniformly within the second high-resistance film 2102, and current crowding is alleviated compared to the case illustrated in FIG. 13. However, a current crowding region 2130 is still present. On the other hand, in the case of the structure according to the present invention illustrated in FIG. 12, the sheet resistance of the second high-resistance film 2102 is greater than or equal to the sheet resistance of the first high-resistance film 2101, and the relationship between the second high-resistance film 2102 and the third high-resistance film 2103 satisfies the above-mentioned Formulae 4. Hence, the current flowing through the first high-resistance film 2101 is slowly dispersed in the second high-resistance film 2102. More specifically, since the second high-resistance film 2102 and the third high-resistance film 2103 have a relationship represented by Formulae 4, even though the second high-resistance film 2102 does not function as an electrode for the first high-resistance film 2101 because the sheet resistance of the second high-resistance film 2102 is greater than or equal to the sheet resistance of the first high-resistance film 2101, the second high-resistance film 2102 appears to function as an electrode for the third high-resistance film 2103. Hence, the current flowing from the first high-resistance film 2101 to the second high-resistance film 2102 is dispersed in the second high-resistance film 2102 while receiving a downward force in the Y direction. Therefore, current crowding due to a sudden dispersion, such as that illustrated in FIG. 14, does not occur. Moreover, unlike the case illustrated in FIG. 13, current crowding does not occur even though the current is dispersed in the second high-resistance film 2102 and flows through a pathway having the shortest distance from the third high-resistance film 2103 to the wires. The reason the relationship between the first high-resistance film 2101 and the second high-resistance film 2102 is defined by using sheet resistance is because the important components of the currents flowing through the first high-resistance film 2101 and the second high-resistance film 2102 are the components orthogonal to the thickness directions of the first high-resistance film and the second high-resistance film.

Next, Formulae 4 are explained.

The electric potential difference in the thickness direction of the second high-resistance film 102 is used as an index for current crowding. This will now be described with reference to FIG. 5.

Figure 5:
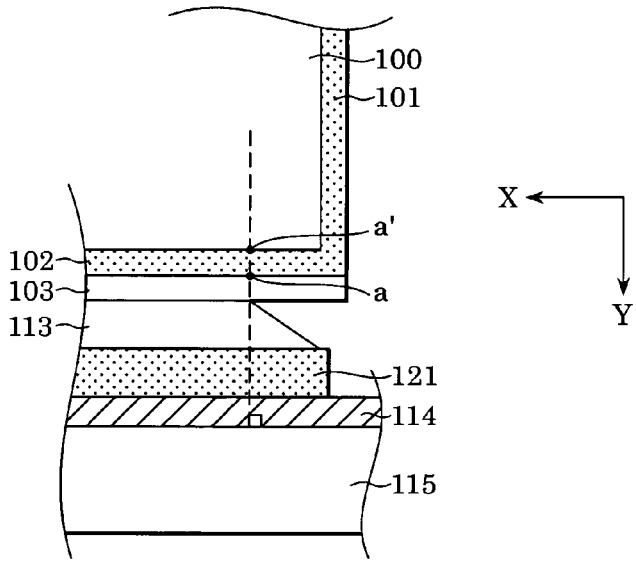
FIG. 5 is a detailed schematic view of the lower portion of the spacer of the display panel according to the present invention.

FIG. 5 is an enlarged view of one of points a and the vicinity indicated in FIG. 2. The components in FIG. 5 are represented by the same reference numerals as in FIG. 2. The electric potential between two points a and a' on a line extending orthogonally from the rear plate 115 or the face plate 117 (refer to FIGS. 1 and 2) and passing through the edge point of the contact area of the third high-resistance film 103 and the horizontal wire 113 is measured. When the potential difference is large, the current flow in the thickness direction of the film (i.e., Y direction in FIG. 5) is large. Therefore, excessive current crowding occurs at the edge of the contact area. On the other hand, when the potential difference is small, the current flow in the film surface direction (i.e., X direction in FIG. 5) is great. Therefore, current crowding at the edge of the contact area is moderate.

Figure 6:
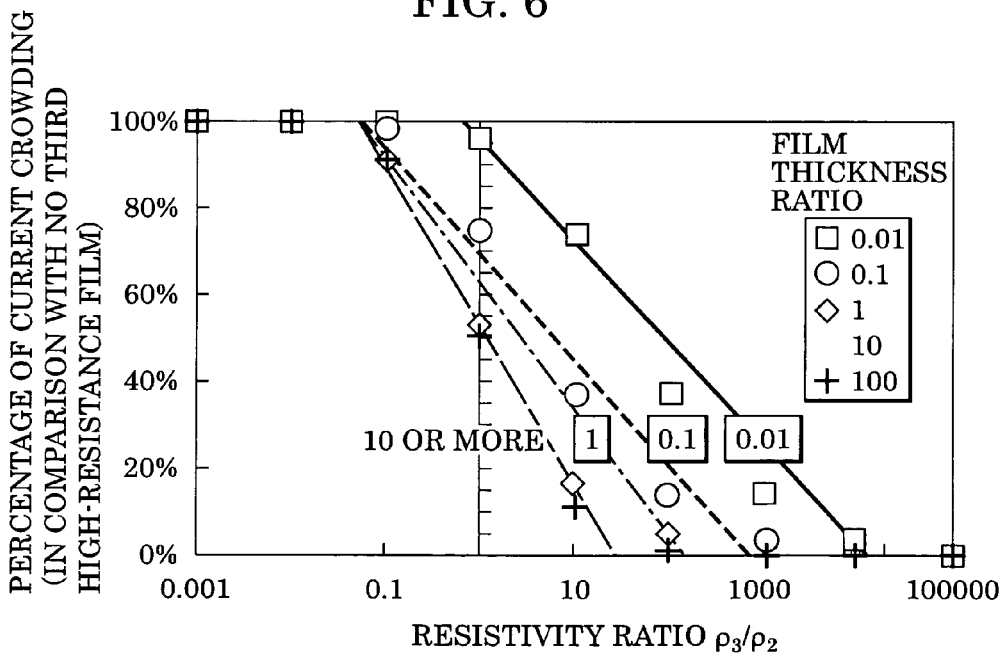
FIG. 6 is a graph representing an alleviation of current crowding by the use of a third high-resistance film according to the present invention.

FIG. 6 is a graph indicating the proportion of the potential difference of a-a' in FIG. 5 (corresponding to a case in which the third high-resistance film 103 (refer to FIG. 2) is provided) to the potential difference of the same points a-a' for a case in which the third high-resistance film 103 is not provided. This proportion is dependent on the resistivity ratio ($\rho_3/\rho_2$). The values for each different film thickness ratio ($t_3/t_2$) are plotted on separate lines representing each film thickness ratio. The horizontal axis of the graph represents the resistivity ratio ($\rho_3/\rho_2$), and the vertical axis represents the proportion of the potential difference (the potential difference of a case in which the third high-resistance film 103 is provided compared to a case in which the third high-resistance film 103 is not provided).

Figure 8:
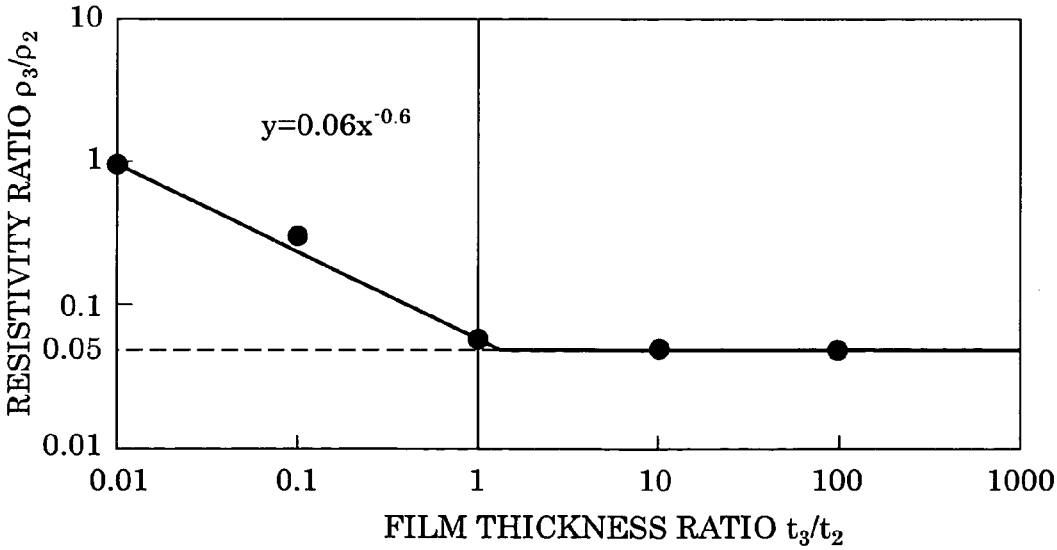
FIG. 8 is a graph representing a preferable relationship between the third high-resistance film and the second high-resistance film according to the present invention.

The area near 100% in the graph of FIG. 6 represents conditions in which the third high-resistance film 103 (refer to FIG. 2) is mostly ineffective for preventing current crowding. The points representing the relationship between the resistivity ratio and the film thickness observed in FIG. 6 when the proportion of the potential difference clearly starts to decrease from 100% (i.e., the critical points (inflection points) where the proportion starts to suddenly decrease) are extracted and re-plotted as a graph of resistivity ratio (vertical axis) over film thickness ratio (horizontal axis), as illustrated in FIG. 8. FIG. 8 is a graph representing a condition in which current crowding can be prevented by using the third high-resistance film 103 at the edge of the contact area. The condition represented here satisfies Formulae 4.

Figure 7:
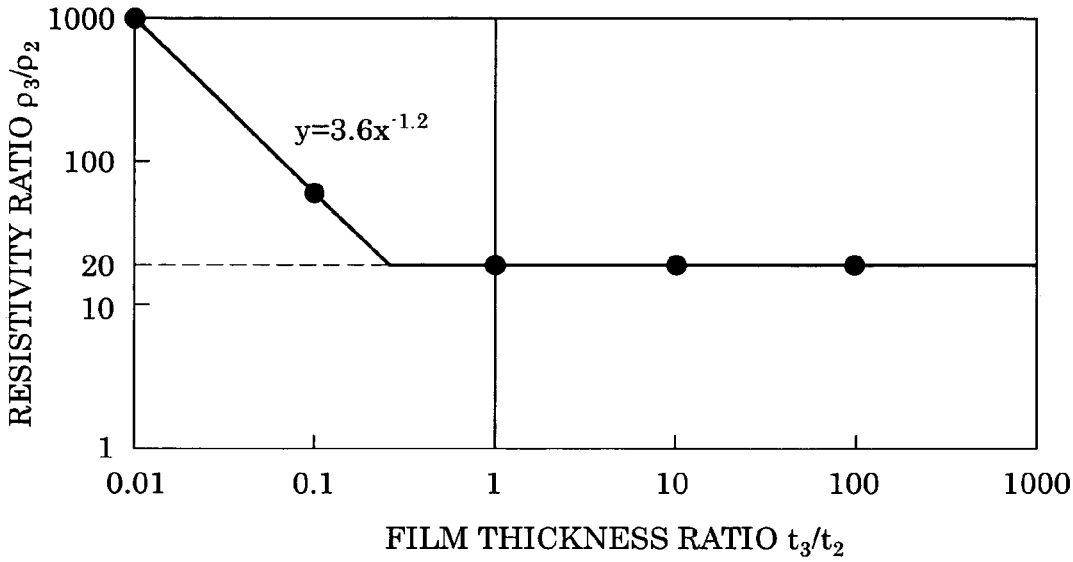
FIG. 7 is a graph representing the relationship between the third high-resistance film and a second high-resistance film according to the present invention.

According to the graph in FIG. 6, as the proportion of current crowding (the ratio of the potential differences of a case in which the third high-resistance film 103 is provided to a case in which the third high-resistance film 103 is not provided) approaches 0%, a double-digit improvement in current crowding prevention is observed. The points representing the relationship between the resistivity ratio and the film thickness observed in FIG. 6 when the decrease in the proportion of the potential difference suddenly becomes moderate as 0% is approached (i.e., the critical points (inflection points) where the decrease in proportion slows down) are extracted and re-plotted on a graph of resistivity ratio (vertical axis) over film thickness ratio (horizontal axis), as illustrated in FIG. 7. By plotting the relationship between the film thickness (horizontal axis) and the resistivity ratio (vertical axis), FIG. 7 represents the conditions in which current crowding is effectively prevented (improved) by the use of the third high-resistance film 103 (refer to FIG. 2). The conditions represented here substantially satisfy Formulae 5 below (which is the same as Formulae 2). This is preferable because when Formulae 5 are satisfied, current crowding is mostly prevented.

[Formulae 5]

$$\frac{\rho_3}{\rho_2} \geq 3.6 \times \left(\frac{t_3}{t_2}\right)^{-1.2} \text{ and } \frac{\rho_3}{\rho_2} \geq 20 \quad (2)$$

The thickness of the third high-resistance film 103 (refer to FIG. 2) should preferably be in the range from $10^{-8}$ m to $10^{-5}$ m. Although the resistance depends on the surface energy of the material, the adhesiveness of the film to the substrate, and the substrate temperature, in general, when the thickness of the third high-resistance film 103 is $10^{-8}$ m or more, the film is formed in patches. Therefore the resistance becomes unstable and difficult to reproduce. When the film thickness is $10^{-5}$ m or more, film stress is increased, causing an increase in the possibility of the film being peeled off. Moreover, when the film thickness is $10^{-5}$ m or more, more time is required for deposition and, thus, productivity decreases. Accordingly, by taking into consideration these upper and lower limits, it is concluded that the preferable film thickness ratio $t_3/t_2$ of the second high-resistance film 102 to the third high-resistance film 103 is between 0.001 and 1,000. The condition represented here substantially satisfies Formula 6 below (which is the same as Formula 3).

[Formula 6]

$$0.001 \leq \frac{t_3}{t_2} \leq 1000 \quad (3)$$

The first high-resistance film 101, illustrated in FIG. 2, receives a current having a value substantially the equal to an acceleration voltage $V_a$, which is applied to the side of the face plate 117 (including components such as the metal back 119) having a higher electric potential, divided by the resistance of the first high-resistance film 101. The sheet resistance of the spacer 120 is set in a preferable range according to the ability of preventing electrical charging and electric power consumption. When the ability of preventing electrical charging is taken into consideration, it is preferable for the sheet resistance to be $10^{14}$ Ω/sq or lower. The lower limit of the sheet resistance depends on the shape of the spacer 120 and the voltage applied to the spacer 120. However, the sheet resistance should preferably be at least $10^7$ Ω/sq. Similarly, the preferable resistivity for the second high-resistance film 102 and the third high-resistance film 103 is determined from the upper and lower limits of the film thickness. The resistivity of the second high-resistance film 102 and the third high-resistance film 103 should preferably be in the rage of 0.1 to $10^8$ Ωm. Moreover, the sheet resistance of the second high-resistance film 102 should preferably be between $10^8$ Ω/sq and $10^{15}$ Ω/sq.

The third high-resistance film 103 may be disposed on the surface of the second high-resistance film 102 of the spacer 120, on the surface of the conductor (horizontal wires 113 or longitudinal wires 114) on the rear plate 115, or on the surface of the electrode (metal back 119) on the face plate 117. The third high-resistance film 103 only has to be disposed between the second high-resistance film 102 and the electrode of the face plate 117 or between the second high-resistance film 102 and the conductor of the rear plate 115. When the third high-resistance film 103 is disposed in only one location, it is preferable to dispose it between the second high-resistance film 102 and the conductor of the rear plate 115. However, it is most preferable to dispose the third high-resistance film 103 at both locations.

FIG. 1 includes electrical terminals Dx1 to Dxm, Dy1 to Dyn, and Hv for electrically connecting the display panel and an electric circuit (not depicted in the drawing). The electrical terminals Dx1 to Dxm are electrically connected to the horizontal wires 113 of the electron source including a plurality of cold cathode electron emitters 112. The electrical terminals Dy1 to Dyn are electrically connected to the longitudinal wires 114 of the electron source. The electrical terminal Hv is electrically connected to the metal back 119 of the face plate 117.

In the display panel described above, when a voltage is applied to each of the cold cathode electron emitters 112 via the electrical terminals Dx1 to Dxm, Dy1 to Dyn, and Hv, electrons are emitted from each of the cold cathode electron emitters 112. Simultaneously, the emitted electrons are accelerated by applying a high voltage of a couple of kilo volts to the metal back 119 via the electrical terminal Hv. The accelerated electrons collide with the inner surface of the face plate 117. As a result, the phosphors for each color making up the fluorescent film 118 are energized, and an image is displayed.

Usually, when a surface-conduction electron emitter is used for the cold cathode electron emitters 112, a voltage of about 12 to 16 V is applied to this surface-conduction electron emitter. The distance between the metal back 119 and the cold cathode electron emitters 112 is about 0.1 to 8 mm. The voltage between the metal back 119 and the cold cathode electron emitters 112 is about 1 to 10 kV.

The structure and overview of the display panel according to an embodiment of the present invention has been described above.

Embodiments

The embodiments of the present invention described below include a flat spacer 120 and horizontal wires 113 as conductors on a rear plate 115. The spacer of the present invention, however, is not limited to a flat spacer and may be a column, a slit, or a cross. The conductors are also not limited to horizontal wires and may be longitudinal wires (such as longitudinal wires 114), a grid plate (not depicted in the drawings), or other surfaces having a predetermined electric potential.

First Embodiment

A first embodiment of the present invention is described with reference to FIG. 1.

As described above, FIG. 1 illustrates a spacer 120 including an insulating substrate 100, a first high-resistance film 101, and a second high-resistance film 102. The first high-resistance film 101 is provided on the surface of the spacer 120 exposed to a vacuum. The second high-resistance film 102 is provided on the surface of the spacer 120 contacting the rear plate 115 or the face plate 117. A third high-resistance film 103 is provided at the contact area of the spacer 120 and the rear plate 115 or the face plate 117. FIG. 1 also illustrates horizontal wires 113, longitudinal wires 114, phosphors 118, and a metal back 119.

PD200 glass manufactured by Asahi Glass Co., Ltd. is used for the rear plate 115, the face plate 117, and the insulating substrate 100 of the spacer 120. The horizontal wires 113 and the longitudinal wires 114 are formed by printing and firing silver paste onto the substrate. The first high-resistance film 101, the second high-resistance film 102, and the third high-resistance film 103 are deposited by sputtering using a WGe alloy target in an $ArN_2$ atmosphere. Films having a desired resistivity and a film thickness were obtained by changing the conditions such as the amount of Ar and $N_2$, the sputtering pressure, and the sputtering time.

In this embodiment, the first high-resistance film 101 and the second high-resistance film 102 were formed under the same conditions so that the resistivity $\rho_1$ and $\rho_2$ equals $2.5\times10^5$ Ωm and the film thickness $t_1$ and $t_2$ equals 100 nm. The third high-resistance film 103 was formed so that its resistivity $\rho_3$ equals $2.5\times10^7$ Ωm and the film thickness $t_3$ equals 600 nm. The third high-resistance film 103 was formed so that it covers the second high-resistance film 102 of the spacer 120. Here, the resistivity ratio $\rho_3/\rho_2$ equals 100. This value is greater than 0.05, which satisfies Formulae 4, and is greater than 20, which satisfies Formulae 5.

A display panel formed according to the first embodiment, as described above, was driven for 1,000 hours at 10 kV, but the displayed image was not distorted. The display panel was disassembled after it was driven for 1,000 hours, and the resistance distribution of the surface of the spacer 120 exposed to the vacuum was measured. The results did not show any difference from the measurements taken from a display panel that had not been driven for 1,000 hours.

Second Embodiment

Figure 9:
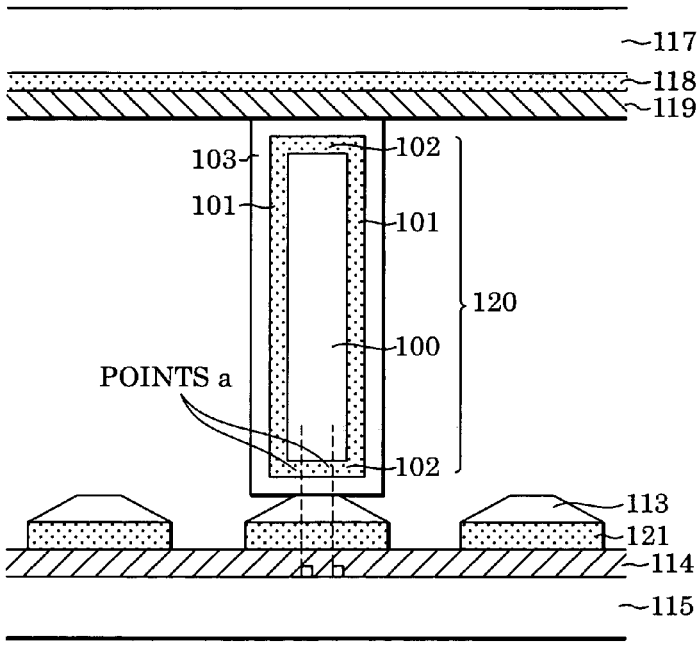
FIG. 9 is a schematic view of a second embodiment of the present invention.

The difference of the second embodiment from the first embodiment is that the third high-resistance film 103 is formed so it entirely covers the surfaces of the first high-resistance film 101 and the second high-resistance film 102. This is illustrated in the cross-sectional schematic view of FIG. 9. The components in FIG. 9 are represented by the same reference numerals as those in FIG. 1.

The resistivity and the film thickness of the first to third high-resistance films 101 to 103 are the same as those in the first embodiment.

A display panel formed according to the second embodiment, as described above, was driven for 1,000 hours at 10 kV, but the displayed image was not distorted. The display panel was disassembled after it was driven for 1,000 hours, and the resistance distribution of the surface of the spacer 120 exposed to the vacuum was measured. The results did not show any difference from the measurements taken from a display panel that had not been driven for 1,000 hours.

Third Embodiment

The difference of the third embodiment from the first embodiment is that the conditions of the first high-resistance film 101 and the second high-resistance film 102 differ. Other aspects of the third embodiment are the same as the first embodiment. In the third embodiment, the resistivity $\rho_1$ and the film thickness $t_1$ of the first high-resistance film 101 equal $2.5\times10^5$ Ωm and 100 nm, respectively. The resistivity $\rho_2$ and the film thickness $t_2$ of the second high-resistance film 102 equal $2.5\times10^5$ Ωm and 10 nm, respectively. In this case, also, the resistivity ratio of the second high-resistance film 102 and the third high-resistance film 103 is 100. This value is greater than 0.05, which satisfies the condition represented by Formulae 4, and greater than 20, which satisfies the condition represented by Formulae 5.

A display panel formed according to the third embodiment, as described above, was driven for 1,000 hours at 10 kV, but the displayed image was not distorted. The display panel was disassembled after it was driven for 1,000 hours, and the resistance distribution of the surface of the spacer 120 exposed to the vacuum was measured. The results did not show any difference from the measurements taken from a display panel that had not been driven for 1,000 hours.

Fourth Embodiment

Figure 10:
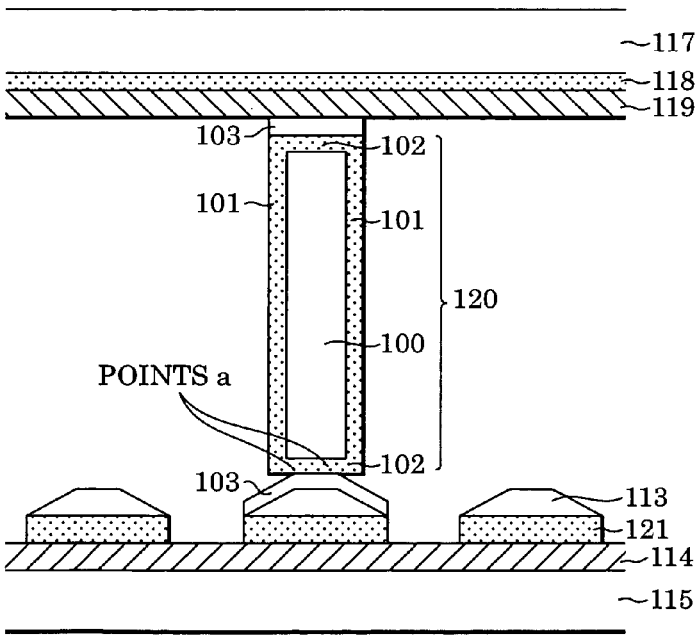
FIG. 10 is a schematic view of a fourth embodiment of the present invention.

The fourth embodiment is described with reference to FIG. 10. As described above, FIG. 10 illustrates a spacer 120 including an insulating substrate 100, a first high-resistance film 101, and a second high-resistance film 102. The first high-resistance film 101 is provided on the surface of the spacer 120 exposed to a vacuum. The second high-resistance film 102 is provided on the surface of the spacer 120 contacting the rear plate 115 or the face plate 117. A third high-resistance film 103 is provided at the contact area of the spacer 120 and the rear plate 115. FIG. 10 also illustrates horizontal wires 113, longitudinal wires 114, phosphors 118, and a metal back 119, and an insulating film 121.

PD200 glass manufactured by Asahi Glass Co., Ltd. is used for the rear plate 115, the face plate 117, and the insulating substrate 100 of the spacer 120. The horizontal wires 113 and the longitudinal wires 114 are formed by printing and firing silver paste onto the substrate. The first high-resistance film 101 and the second high-resistance film 102 are deposited by sputtering using a WGe alloy target in an $ArN_2$ atmosphere. Films having desired resistivity and film thickness were obtained by changing the conditions such as the amount of Ar and $N_2$, the sputtering pressure, and the sputtering time.

In this embodiment, the resistivity $\rho_1$ and the film thickness $t_1$ of the first high-resistance film 101 equal $2.5\times10^5$ Ωm and 100 nm, respectively. The resistivity $\rho_2$ and the film thickness $t_2$ of the second high-resistance film 102 equal $2.5\times10^5$ Ωm and 10 nm, respectively. The third high-resistance film on the spacer is formed in the same manner as the first embodiment.

The third high-resistance film 103 on the horizontal wires 113 is formed by applying antimony tin oxide (ATO) having a resistivity $\rho_3$ of $3\times10^4$ Ωm by spraying onto the horizontal wires 113 to obtain a thickness of 10 nm. The horizontal wires 113 are disposed on and in contact with the rear plate 115 of the spacer 120. The layers on the rear plate 115 have a resistivity ratio of 0.12. This value is greater than 0.05 and satisfies the condition represented by Formulae 4.

A display panel formed according to the fourth embodiment, as described above, was driven for 1,000 hours at 10 kV, but the displayed image was not distorted. The display panel was disassembled after it was driven for 1,000 hours, and the resistance distribution of the surface of the spacer 120 exposed to the vacuum was measured. The results did not show any difference from the measurements taken from a display panel that had not been driven for 1,000 hours.

Fifth Embodiment

The difference between the fifth embodiment and the fourth embodiment is that the third high-resistance film 103 on the rear plate 115 is formed by printing an insulation paste instead of ATO. After firing, the resistivity $\rho_3$ of the insulating layer is at least 1010 Ωm and the film thickness is 5 μm. The resistivity ratio of the films on the rear plate 115 is at least $4\times10^6$. This value is greater than 0.05, which satisfies the condition represented by Formulae 4, and greater than 20, which satisfies the condition represented by Formulae 5.

A display panel formed according to the fifth embodiment, as described above, was driven for 1,000 hours at 10 kV, but the displayed image had no noticeable differences from the initial image. The display panel was disassembled after it was driven for 1,000 hours, and the resistance distribution of the surface of the spacer 120 exposed to the vacuum was measured. The results did not show any difference from the measurements taken from a display panel that had not been driven for 1,000 hours.

The above-described image forming device according to the present invention may be applied to a television set. The image forming device according to the present invention being applied to a television set will be described below.

Figure 15:
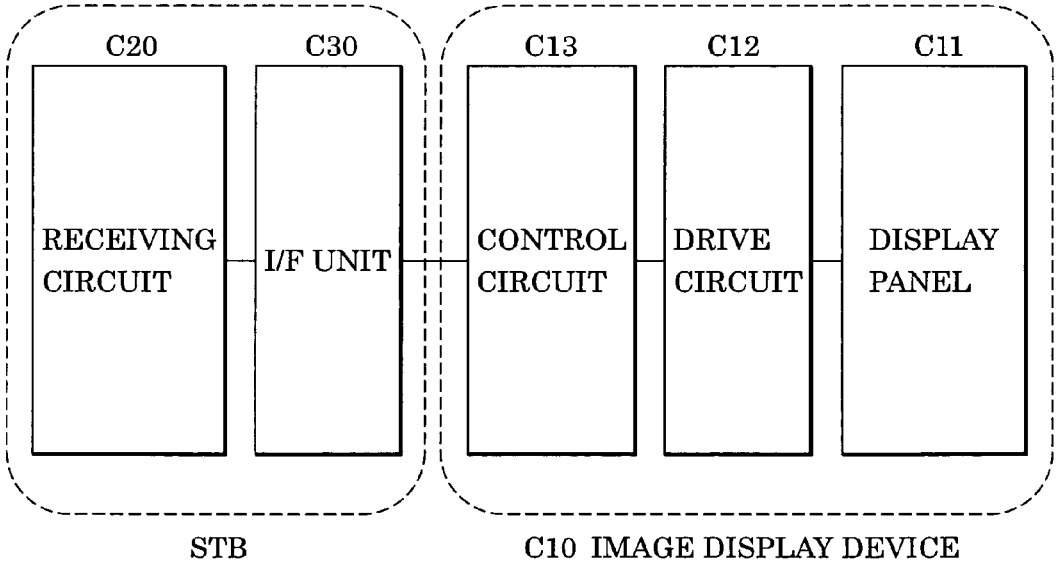
FIG. 15 is a block diagram of a television apparatus.

FIG. 15 is a block diagram of a television apparatus according to the present invention. A receiving circuit C20 includes a tuner and decoder for receiving satellite broadcasting, television signals via ground waves, and data-casting via a network. The receiving circuit C20 outputs a coded image signal to an interface (I/F) unit C30. The I/F unit C30 converts the format of the image data into a format according to a display apparatus C10. Then, this converted image data is sent to the display apparatus C10. The display apparatus C10 includes a drive circuit C12 and a control circuit C13. The image forming device illustrated in FIG. 1 may be used as the display apparatus C10. The control circuit C13 carries out image processing such as corrections to the input image data in accordance with the display panel and outputs the image data and various control signals to the drive circuit C12. The drive circuit C12 outputs a drive signal to the display panel C11 based on the input image data to display a television image.

The receiving circuit C20 and the I/F unit C30 may be disposed in a case separate from the display apparatus as a setup box (STB) or may be disposed in the same case as the display apparatus.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

This application claims priority from Japanese Patent Application No. 2004-000161 filed Jan. 5, 2004, which is hereby incorporated by reference herein.

What is claimed is:

1. An image forming device comprising:

a rear plate having a conductor set to a low voltage;

an electron emitter disposed on the rear plate, the electron emitter including the conductor;

a face plate having an electrode set to a high voltage, the face plate facing the rear plate;

image forming means provided on the face plate, the image forming means including the electrode;

a spacer electrically connected to the conductor and the electrode;

the spacer comprising:

an insulating substrate having a first end surface facing the rear plate, a second end surface facing the electrode, and side surfaces connecting the first end surface and the second end surface;

a first high-resistance film covering the side surfaces of the insulating substrate; and a second high-resistance film covering at least one of the first end surface and the second end surface of the insulating substrate and having a sheet resistance greater than or equal to a sheet resistance of the first high-resistance film;

wherein the spacer, the conductor and the electrode are electrically connected via a third high-resistance film interposed between the conductor or the electrode and the second high-resistance film, and wherein the resistivity $\rho_2$ and the film thickness $t_2$ of the second high-resistance film and the resistivity $\rho_3$ and the film thickness $t_3$ of the third high-resistance film satisfy the formulae below:

$$\frac{\rho_3}{\rho_2} \geq 3.6 \times \left(\frac{t_3}{t_2}\right)^{-1.2} \text{ and } \frac{\rho_3}{\rho_2} \geq 20. \quad (1)$$

2. The image forming device according to claim 1, wherein the second high-resistance film and the third high-resistance film satisfy the formula below:

$$0.001 \leq \frac{t_3}{t_2} \leq 1000. \quad (2)$$

3. The image forming device according to claim 1, wherein the film thickness $t_2$ of the second high-resistance film and the film thickness $t_3$ of the third high-resistance film are both between $10^{-8}$ m and $10^{-5}$ m.

4. The image forming device according to claim 1, wherein the resistivity $\rho_2$ of the second high-resistance film and the resistivity $\rho_3$ of the third high-resistance film are both between 0.1 Ω/sq and $10^8$ Ω/sq.

5. The image forming device according to claim 1, wherein the sheet resistance of the first high-resistance film and the sheet resistance of the second high-resistance film are substantially the same.

6. The image forming device according to claim 1, wherein the sheet resistance of the first high-resistance film is between $10^7$ Ω/sq and $10^{14}$ Ω/sq, and the sheet resistance of the second high-resistance film is between $10^8$ Ω/sq and $10^{15}$ Ω/sq.

7. A television apparatus comprising:

a rear plate having a conductor set to a low voltage;

an electron emitter disposed on the rear plate, the electron emitter including the conductor;

a face plate having an electrode set to a high voltage, the face plate facing the rear plate;

image forming means provided on the face plate, the image forming means including the electrode;

a spacer electrically connected to the conductor and the electrode;

the spacer comprising:

an insulating substrate having a first end surface facing the rear plate, a second end surface facing the electrode, and the side surfaces connecting the first end surface and the second end surface;

a first high-resistance film covering the side surfaces of the insulating substrate; and a second high-resistance film covering at least one of the first end surface and the second end surface of the insulating substrate and having a sheet resistance greater than or equal to a sheet resistance of the first high-resistance film;

wherein the spacer, the conductor and the electrode are electrically connected via a third high-resistance film interposed between the conductor or the electrode and the second high-resistance film, and wherein the resistivity $\rho_2$ and the film thickness $t_2$ of the second high-resistance film and the resistivity $\rho_3$ and the film thickness $t_3$ of the third high-resistance film satisfy the formulae below:

$$\frac{\rho_3}{\rho_2} \geq 3.6 \times \left(\frac{t_3}{t_2}\right)^{-1.2} \text{ and } \frac{\rho_3}{\rho_2} \geq 20 \quad (1)$$

a television signal receiving circuit; and an interface unit for connecting the image forming device and the television signal receiving circuit.

* * * * *